United States Patent [19]

Flanagan

[11] 3,995,116

[45] Nov. 30, 1976

[54] EMPHASIS CONTROLLED SPEECH SYNTHESIZER

[75] Inventor: James Loton Flanagan, Warren, N.J.

[73] Assignee: Bell Telephone Laboratories, Incorporated, Murray Hill, N.J.

[22] Filed: Nov. 18, 1974

[21] Appl. No.: 524,789

[52] U.S. Cl. ..... 179/1 SM

[51] Int. Cl.[2] ..... G10L 1/00

[58] Field of Search ..... 179/1 SA, 1 SF, 1 SM

[56] References Cited

UNITED STATES PATENTS

| | | | |
|---|---|---|---|
| 3,349,180 | 10/1967 | Coker | 179/1 SA |
| 3,360,610 | 12/1967 | Flanagan | 179/1 SA |
| 3,704,345 | 11/1972 | Coker et al. | 179/1 SF |
| 3,828,132 | 8/1974 | Flanagan et al. | 179/1 SA |

OTHER PUBLICATIONS

Lee F., "Reading Machine: Text to Speech," IEEE Trans. on Audio, vol. AU-17, No. 4, Dec. 1969.

*Primary Examiner*—Kathleen H. Claffy
*Assistant Examiner*—E. S. Matt Kemeny
*Attorney, Agent, or Firm*—H. L. Logan; Robert O. Nimtz

[57] ABSTRACT

Disclosed is a system for synthesizing emphasis-controlled speech from stored signals representative of words precoded by a phase vocoder having analysis bands which are wide relative to the voice harmonic frequency spacings. The stored signals comprise short-time Fourier transform parameters which describe the magnitude and the phase derivative of the short-time speech spectrum. Speech emphasis-controlled synthesis is achieved by extracting the stored signals of chosen words under control of a pitch-duration signal, by concatenating the extracted signals, by modifying the magnitude parameters of the extracted signals to effect a desired speech intensity, by interpolating the extracted parameters, and by decoding the resultant signals in accordance with phase vocoder techniques.

5 Claims, 5 Drawing Figures

EMPHASIS CONTROLLED SPEECH SYNTHESIZER

BACKGROUND OF THE INVENTION

This invention relates to apparatus for forming and synthesizing natural sounding speech.

To synthesize speech signals from stored information it is, generally, advantageous to code the stored speech elements into a convenient and an efficient code. Most speech synthesis apparatus use coded speech signals based on the formant information contained in the phonemes of the speech signals. In one sense, this is the natural approach to speech coding because it reflects the process by which speech is vocally generated in the human throat. One such speech synthesis system is disclosed by me in U.S. Pat. No. 3,838,132 issued Aug. 6, 1974.

However, other schemes for coding analog signals exist. One such scheme, for example, involves the use of vocoder techniques to encode analog signals, and particularly speech signals. This has been disclosed in U.S. Pat. No. 3,360,610 issued to me on Dec. 26, 1967. Therein a communication arrangement is described in which speech signals to be transmitted are encoded into a plurality of narrow band components which occupy a combined bandwidth narrower than that of the unencoded speech. Briefly summarized, phase vocoder encoding is performed by computing, at each of a set of predetermined frequencies, $\omega_i$, which span the frequency range of an incoming speech signal, a pair of signals respectively representative of the real and the imaginary parts of the short-time Fourier transform of the original speech signal. From each pair of such signals there is developed a pair of narrow band signals; one signal, $|S_i|$, representing the magnitude of the short-time Fourier transform, and the other signal, $\dot{\phi}_i$, representing the time derivative of the phase angle of the short-time Fourier transform. In accordance with the above communication arrangement, these narrow band signals are transmitted to a receiver wherein a replica of the original signal is reproduced by generating a plurality of cosine signals having the same predetermined frequencies at which the short-time Fourier transforms were evaluated. Each cosine signal is then modulated in amplitude and phase angle by the pairs of narrow band signals, and the modulated signals are summed to produce the desired replica signal.

The phase vocoder art has been extended by J. P. Carlson, in a paper entitled "Digitalized Phase Vocoder," published in the *Proceedings of the* 1967 *Conference on Speech Communication and Processing*, pages 292–296, wherein Carlson describes the digitizing of the narrow band signals $|S_i|$ and $\dot{\phi}_i$ before transmission, and indicates that at a 9600 bit/second transmission rate, for example, the degradation due to digitization of the parameters is unnoticeable in the reconstructed speech signal.

In another article, entitled "Phase Vocoder," by J. L. Flanagan et al, *Bell System Technical Journal*, Volume 45, No. 9, November 1966, page 1493, it is shown that if the analyzing bandwidth of the phase vocoder is narrow compared to the total speech bandwidth, then the phase derivative signal is representative of the pitch of the speech signal, and the magnitude of the short-time spectrum signal is representative of the strength of the speech signal at particular frequency bands. Utilizing this characteristic, in a copending application, Ser. No. 476,577, filed June 5, 1974 (Case 31) a system is disclosed which synthesizes speech from stored signals of vocabulary words encoded by a phase vocoder having narrow analyzing bands as compared to the bandwidth of the encoded signal. In accordance with the invention disclosed in this copending application, natural sounding speech is formed and synthesized by withdrawing from memory stored signals corresponding to the desired words, by concatenating the withdrawn signals, and by independently modifying the duration and pitch of the concatenated signals. Duration control is achieved by inserting between successively withdrawn different signals a predetermined number of interpolated signals. This causes an effective slowdown of the speech with no frequency distortion. Control of pitch is achieved by multiplying the phase derivative signals by a chosen factor. Speech synthesis is completed by converting the modified signals from digital to analog format and by decoding the signals in accordance with known phase vocoder techniques.

To the best of applicant's knowledge, the prior art does not disclose a system which directly controls the emphasis characteristic of synthesized speech. Accordingly, one objective of this invention is to provide a system for synthesizing natural sounding speech wherein the emphasis characteristic of speech is effectively controlled.

Another objective of this invention is to synthesize speech from stored signals of vocabulary words encoded in accordance with phase vocoder techniques.

SUMMARY OF THE INVENTION

These and other objectives of the invention are achieved by utilizing a stored vocabulary of words encoded with a phase vocoder into a plurality of short-time magnitude signals and short-time phase derivative signals to form the synthesized speech signals. Unlike the phase vocoder encoded vocabulary of words used in my aforementioned patent application Ser. No. 476,577, the phase vocoder used encoding the vocabulary of words exhibits wide analysis bands which contain several voice harmonics of the analyzed speech. With such analysis bands, the short-time magnitude signals contain both spectrum envelope information and voice pitch information in a manner which uniquely lends itself to the control of emphasis in the synthesized speech.

Natural sounding speech is formed and synthesized in accordance with this invention by withdrawing from memory stored signals corresponding to the desired words, by concatenating the withdrawn signals, and by appropriately modifying the short-time magnitude signals of the concatenated signals to effect speech emphasis signals. More particularly, speech emphasis in the synthesized speech is controlled by modifying the duration of the extracted signals and by controlling the general level of the short-time magnitude signals.

In natural speech sounds, subjective emphasis is related to pitch, duration and intensity. This relationship is generally complex and dependent upon contextual constraints. In general, it can be said, however, that an increase in intensity, a decrease in duration and an increase in pitch emphasizes the utterances. In accordance with this invention, therefore, the pitch and duration are controlled by inserting between successively withdrawn signals a predetermined number of interpolated signals. This causes an effective slowdown (increased duration) of the synthesized speech and a proportional lowering of the pitch period. But there is no shift of formant frequencies, and the bandwidth remains (essentially) constant. Amplitude control of the short-time amplitude spectrum signals achieves intensity control of the synthesized speech. Speech synthesis is completed by converting the modified signals from digital to analog format and by decoding the signals in accordance with known phase vocoder techniques.

DETAILED DESCRIPTION

Figure 1:
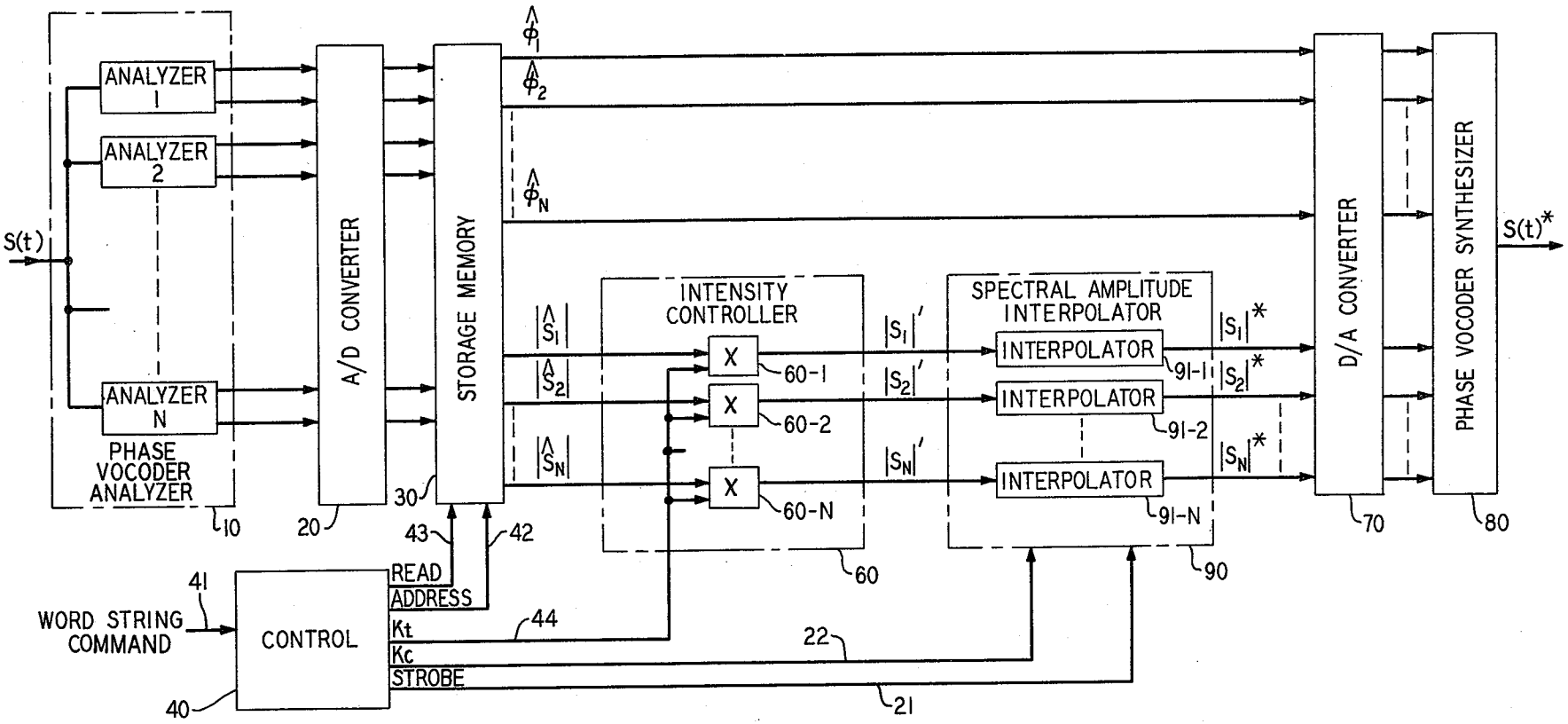
FIG. 1 depicts a schematic block diagram of a speech synthesis system in accordance with this invention.

FIG. 1 illustrates a schematic block diagram of a speech synthesis system wherein spoken words are encoded into phase vocoder description signals, and wherein speech synthesis is achieved by extracting proper description signals from storage, by concatenating and modifying the description signals, and by decoding and combining the modified signals into synthesized speech signals.

More specifically, the vocabulary of words which is deemed necessary for contemplated speech synthesis is presented to phase vocoder analyzer 10 of FIG. 1 for encoding. Analyzer 10 encodes the words into a plurality of signal pairs, $|S_1|, \dot{\phi}_1; |S_2|, \dot{\phi}_2; \ldots |S_i|, \dot{\phi}_i, \ldots |S_N|, \dot{\phi}_N$, constituting an $|S|$ vector, and a $\dot{\phi}$ vector where each $|S_i|$ and $\dot{\phi}_i$, respectively, represent the short-time magnitude spectrum, and the short-time phase derivative spectrum of the speech signal determined at a spectral frequency $\omega_1$. The analyzing frequencies, $\omega_i$, may be spaced uniformly or nonuniformly throughout the frequency band of interest as dictated by design criteria. The analyzing bands of the phase vocoder of this invention must be wide enough so that several voice harmonics fall into each band. For example, an appropriate set of analyzing bandwidths might be a set of bandwidths which are one octave wide, i.e., 300–600 Hz, 600–1200 Hz, 1200–2400 Hz, etc. The analyzing bands might also be of equal bandwidths. Phase vocoder analyzer 10 may be implemented as described in the aforementioned Flanagan U.S. Pat. No. 3,360,610.

Following encoding by analyzer 10, the $|S|$ and $\dot{\phi}$ analog vectors are sampled and converted to digital format in A/D converter 20. Converter 20 may be implemented as described in the aforementioned Carlson paper. The converted signals are stored in storage memory 30 of FIG. 1, and are thereafter available for the synthesis process. Since each word processed by analyzer 10 is sampled at a relative high rate, e.g. 10 KHz, each processed word is represented by a plurality of $|S|$ vectors and associated $\dot{\phi}$ vectors. These vectors are inserted into memory 30 in a sequential manner in dedicated blocks of memory. Within each block of memory, each pair of $|S|$ and $\dot{\phi}$ vectors is stored in one memory location, and each memory location is subdivided and made to contain the components $|S_i|$ and $\dot{\phi}_i$ of each vector.

Speech synthesis is initiated when a user presents a string of commands to device 40 of FIG. 1 via lead 41. The string of commands dictates to the system the sequence of words which are to be selected from memory 30 and concatenated to form a speech signal. In response thereto, selected blocks of memory are accessed sequentially, and within each memory block all memory locations are accessed sequentially. Each memory location presents to the output port of memory 30 a pair of $|S|$ and $\dot{\phi}$ vectors. Control device 40 operates on the input command string and applies appropriate addresses and READ commands to memory 30. Additionally, device 40 analyzes the word string structure, assigns a pitch-duration value $K_{pd}$ and an intensity value $K_i$, and computes an interpolation constant $K_c$ for each accessed memory location, to provide for natural sounding speech having an emphasis pattern which is dependent on the word string structure. A detailed description of control device 40 is hereinafter presented.

Since the $|S|$ vector signals carry voice pitch information, a lengthening of the periodic detail of the $|S_i|$ signals results in a slowing and a lowering of the pitch of the synthesized speech. It can be shown that the lengthening of the $\dot{\phi}$ signals does not translate in frequency and does not cause frequency bandwidth changes characteristic of the "Donald Duck" effect (i.e. large shift of formant frequencies) in "helium" speech and tape recorder speed changes, and in speech uttered in a Helium-Oxygen environment, as described by J. D. MacLean in "Analysis of Speech in a Helium-Oxygen Mixture Under Pressure," *Journal of Acoustical Society of America*, Vol. 4, No. 3, 1966, p. 625.

This invention controls speech pitch and duration by controlling (lengthening or shortening) the periodic details of the $|S|$ and $\dot{\phi}$ vectors. This control is achieved by repeated accessing of each selected memory location at a fixed high frequency clock rate, $f_s$, and by controlling the number of such repeated accesses. In this manner, speech pitch and speech duration is effectively increased by increasing the number of times each memory is accessed, or decreased by decreasing the number of times each memory location is accessed. That is, if the nominal number of accesses for each memory address is set at some fixed number, say 100, repeated accessing of each memory location of more than 100 times causes a slowdown in the synthesized speech and a lowering of the pitch, and repeated accessing of each memory location of less than 100 times causes a speedup in the synthesized speech and a raising of the pitch. The exact number of times that each memory location is accessed is dictated by control circuit 40 via repeated READ commands on lead 43 for each memory address on lead 42.

Figure 2:
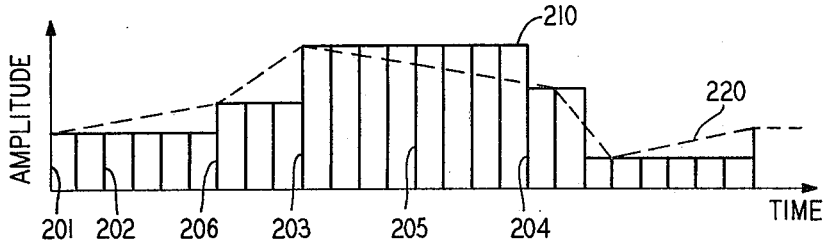
FIG. 2 illustrates the short-time spectral waveform of the $i^{th}$ spectrum signal $|S_i|$ at the output of the storage memory 30 of FIG. 1.

The above approach to speech pitch-duration control is illustrated in FIG. 2 which depicts the amplitude of a particular $|\hat{S}_i|$ component as it varies with time. The designation $|\hat{S}|$ represents the vector $|S|$ at the output of memory 30. In FIG. 2, element 201 represents the value of $|\hat{S}_i|$ at a particular time as it appears at the output of memory 30 in response to the accessing of a particular memory location, $v$. Element 201 is the first accessing of the $v^{th}$ memory location. Element 202 also represents the value of $|\hat{S}_i|$ at location $v$, but it is the third time that the location v is accessed. Element 206 represents the value of $|\hat{S}_i|$ at memory location $v+1$, and it represents the initial accessing of location $v+1$. If, for example, location $v$ is the last location of a memory block (end of a word), then element 203 represents the value of $|\hat{S}_i|$ at an initial accessing of a new memory block (beginning of a new word) at a memory location $u$ rather than the signal of memory $v+1$. Element 205 also represents the value of $|\hat{S}_i|$ at location $u$, but at a subsequent accessing time, and element 204 represents the final accessing of memory location $u$. The number of times a memory is accessed is dictated by the pitch-duration control constant $K_{pd}$ from which an interpolation constant $K_c$ is developed in control circuit 40 to actuate a spectral interpolator 90, shown in FIG. 1.

Only the $i^{th}$ component of the $|\hat{S}|$ vector at the output of memory 30 is illustrated in FIG. 2. Other components of the $|\hat{S}|$ vector and the components of the $\hat{\phi}$ vector have, of course, different values, but the general staircase shape remains unchanged and the break points due to changes in memory location within a memory block (e.g., time element 206) or due to changes of memory location from one memory block to another (e.g., time element of 205) occur at the same instants of time.

INTENSITY CONTROL

Since speech intensity is indicated by the general level of the $|\hat{S}|$ vectors, the intensity of the synthesized speech is controlled in the apparatus of FIG. 1 by multiplying the $|\hat{S}|$ signals at the output of memory 30 by an intensity factor $K_t$ (nominally 1.0) derived from control circuit 40. The intensity control factor generally accentuates a word or a group of words. Accordingly, the $K_t$ factor is constant for a whole block of memory 30 addresses or for a group of memory blocks. Multiplication by $K_t$ has no effect, therefore, on the general staircase shape of the spectrum as illustrated in FIG. 2, including no change in the locations of the step discontinuities.

The $K_t$ multiplication is accomplished within intensity controller 60 which is connected to memory 30 and is responsive to the short-time spectrum amplitude signals $|\hat{S}|$. Intensity controller 60 comprises a plurality of multiplier circuits 60-1, 60-2, . . . 60-N, each respectively multiplying signals $|\hat{S}_1|$, $|\hat{S}_2|$, . . . $|\hat{S}_N|$ by the constant factor $K_t$, yielding intensity modified signals $|\hat{S}_1|$, $|\hat{S}_2|'$, . . . $|\hat{S}_N|'$. Each of the multipliers 60-1, 60-2, . . . 60-N are simple digital multipliers which are well known in the art of electronic circuits.

SPECTRUM SHAPE INTERPOLATOR

As indicated above, the intensity modified spectrum envelope $|\hat{S}|'$ has a staircase shape. Although such a spectrum envelope may be used for the synthesis process, it is intuitively apparent that smoothing out of the spectrum would more closely represent a naturally developed spectrum envelope and would, therefore, result in more pleasing and more natural sounding synthesized speech. One approach to envelope smoothing may be the "fitting" of a polynomial curve over the initial $|\hat{S}_i|'$ values when a new memory address is accessed. If the spectrum shown in FIG. 2 is thought to represent the intensity controlled spectrum $|\hat{S}_i|'$, then the desired envelope smoothing may be a curve fitting over elements 201, 206, and 203. The repeated $|\hat{S}_i|'$ values, i.e., the elements between elements 201, 206, and 203, may be altered to fit within that curve. This, however, is a complex mathematical task which requires the aid of special-purpose computing circuitry, or a general purpose computer. For purposes of clarity, therefore, a more simple, straight line interpolation approach is described herein. The short-time spectral waveform resulting from the straight line interpolation approach is illustrated by curve 220 of FIG. 2.

In accordance with the chosen straight line interpolation approach, if element 203 is designated as $S_i^{m_1}$, defining $|\hat{S}_i|'$ signal at time $m_1$, element 204 is designated as $S_1^{m_2}$, and element 205 is designated as $S_i^{m_x}$, it can be shown that the interpolated element of 205, "fitting" curve 220, can be computed by evaluating $$(S_i^{m_1} - S_i^{m_2})\, K_c + S_i^{m_1} \qquad (1)$$

where $$K_c = (m_x - m_1)/(m_2 - m_1). \qquad (2)$$

It can be noted by observing the above equations that, unlike the intensity control, the smoothing process is dependent on the values of the spectrum envelope signals and on the number of times that each memory address is accessed.

Figure 3:
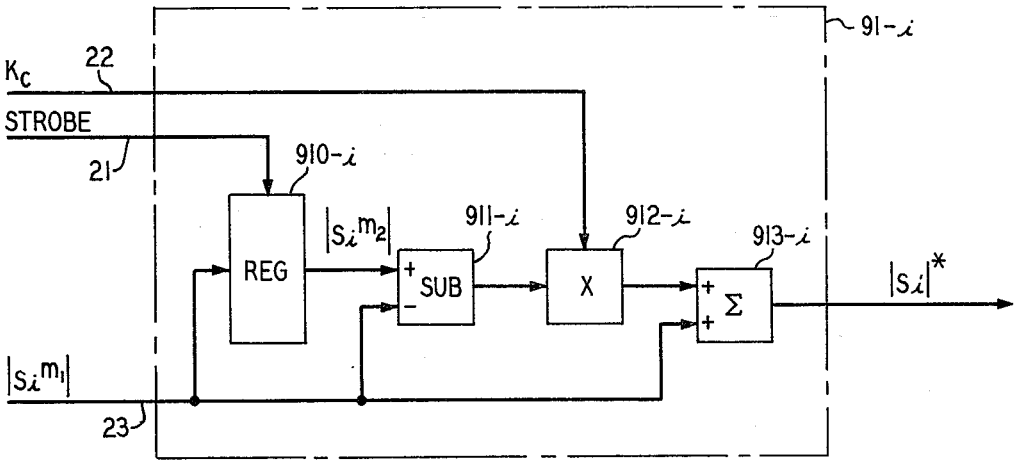
FIG. 3 depicts a block diagram of the interpolator circuit of FIG. 1.

To provide for the above-described "smoothing" of the synthesized spectrum's envelope, FIG. 1 includes a spectrum amplitude interpolator 90, interposed between intensity controller 60 and D/A converter 70. At one extreme, interpolator 90 may simply be a short-circuit connection between each $|\hat{S}_i|'$ input and its corresponding interpolated $|\hat{S}_1|^*$ output. This really corresponds to no interpolation at all. At the other extreme, interpolator 90 may comprise a plurality of interpolator 91 devices embodied by highly complex special purpose or general purpose computers, providing a sophisticated curve fitting capability. FIG. 3 illustrates an embodiment of interpolator 91 for the straight line interpolation approach defined by equation (1).

Interpolator **91-*i* shown in FIG. 3 is the $i^{th}$ interpolator in device 90, and is responsive to the initial memory accessing of the present memory address signal $S_i^{m1}$, and to the spectrum signal of the next memory address signal $S_i^{m2}$. Thus, when a new memory 30 address is accessed and the $S_i^{m1}$ signal is obtained, control device 40 also addresses the next memory location and provides a strobe pulse (on lead 21) to strobe the next signal $S_i^{m2}$ into register 910. The positive input of subtractor 911 is connected to register 910 and is responsive to the $S_i^{m2}$ signal, and the negative input of subtractor 911 is connected to lead 23 and is responsive to the $S_i^{m1}$ signal. The signal defined by equation (1) is computed by multiplier 912 which is responsive to subtractor 911 and to the aforementioned $K_c$ factor on lead 22, and by summer 913 which is responsive to multiplier 912 output signal and to the $S_i^{m1}$ signal on lead 23**.

SPEECH GENERATION

Speech is generated by converting the modified digital signals to analog format and by synthesizing speech therefrom. Accordingly, a D/A converter 70 is connected to the pitch-duration modified and intensity modified interpolated $|\hat{S}|^*$ vector at the output of interpolator 90, and to the pitch-duration modified $\hat{\phi}$ vector at the output of memory 30. Converter 70 converts the applied digital signals into analog format and applies the analog signals to a phase vocoder synthesizer 80 to produce a signal representative of the desired synthesized speech. Converter 70 may comprise 2N standard D/A converters; N converters for the $|\hat{S}|^*$ components and N converters for the $\phi$ components. Phase vocoder 80 may be constructed in essentially the same manner as disclosed in the aforementioned Flanagan U.S. Pat. No. 3,360,610.

CONTROL DEVICE 40

Figure 4:
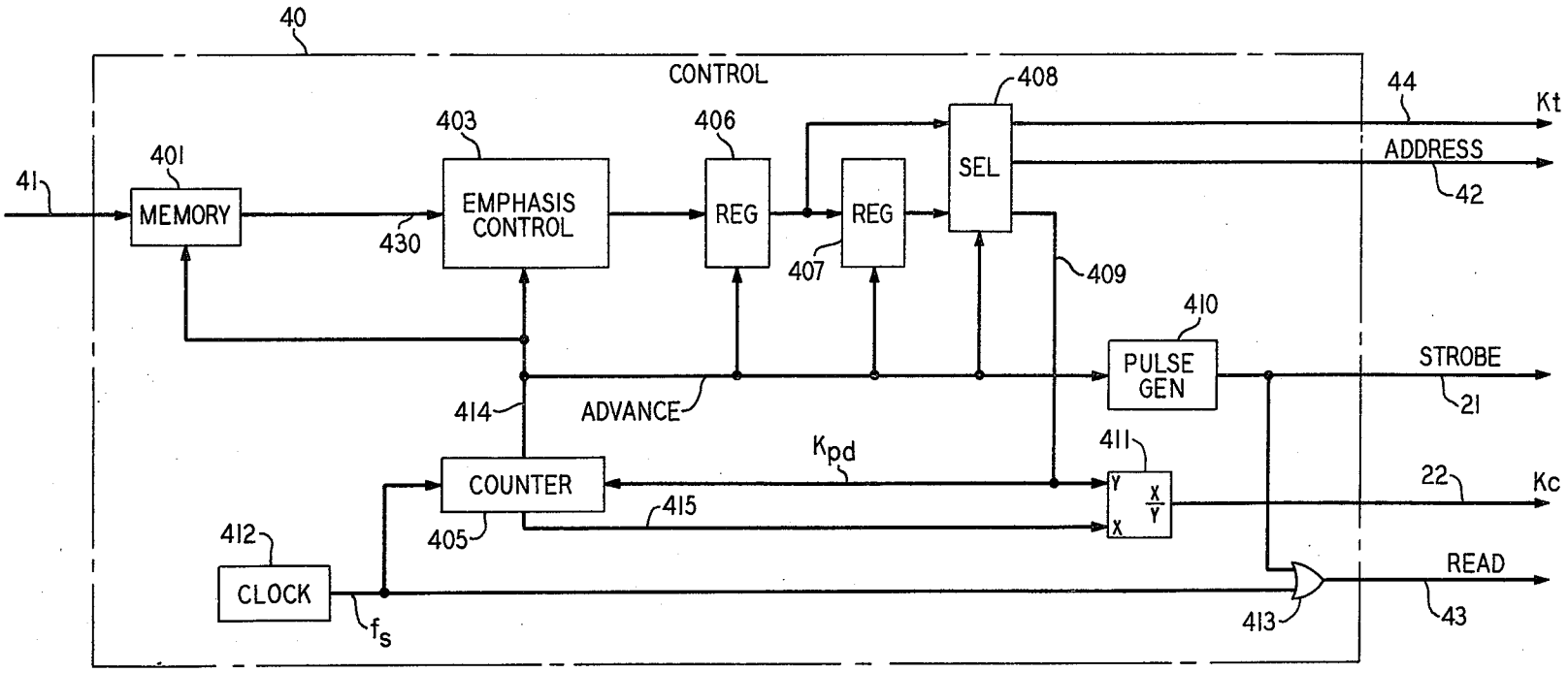
FIG. 4 depicts an embodiment of the control circuit 40 of FIG. 1.

FIG. 4 depicts a schematic diagram of the control device 40 of FIG. 1. In accordance with this invention, device 40 is responsive to a word string command signal on lead 41 which dictates the message to be synthesized. For example, the desired message may be "The number you have dialed has been changed." The input signal sequence (on lead 41) for this message may be "1", "7", "13", "3", "51", "17", "62", "21", "99", with "99" representing the period at the end of the sentence. The input sequence corresponds to the initial addresses of blocks of memory 30 locations wherein the desired words are stored.

The desired word sequence, as dictated by the string of command signals, is stored in memory 401 and thereafter is analyzed in emphasis control block 403 to determine the desired pitch-duration and intensity factors for each word in the synthesized sentence. The pitch-duration and intensity factors may be computed by positional rules dependent on word position, by syntax rules, or by other sentence or word dependent rules.

Positional rules are generally simple because they are message independent. For example, a valid positional rule may be that the second word in a sentence is to be emphasized by lengthening it by a factor of 1.2 and by increasing its intensity by a factor of 1.3, that the last word in a sentence is to be de-emphasized by shortening it to 0.98 of its original duration and by decreasing the intensity by a factor of 0.7 and that all other words remain unchanged from the way they are stored.

Figure 5:
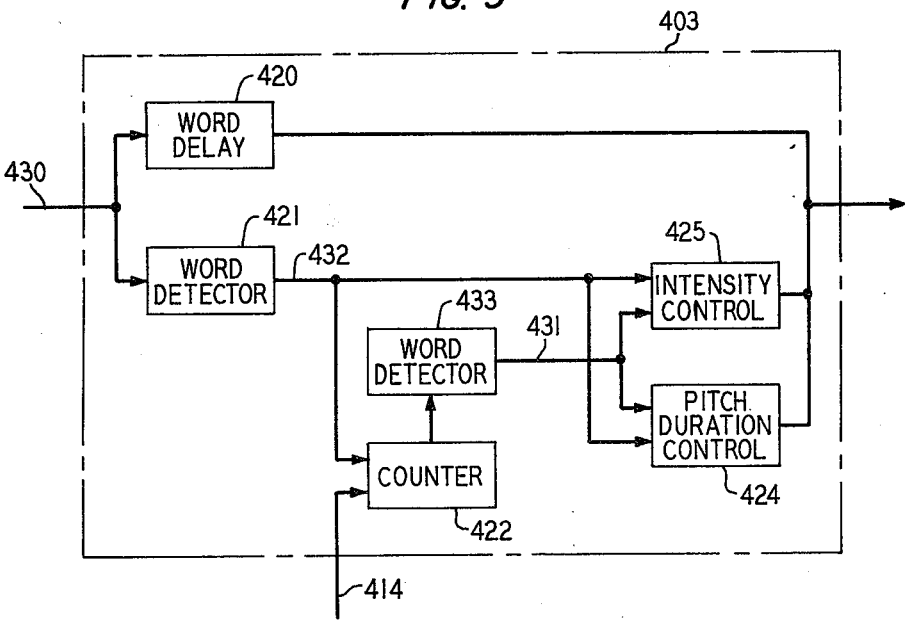
FIG. 5 depicts an embodiment of the emphasis control circuit 403 of FIG. 4.

FIG. 5 depicts an emphasis control block 403, responsive to the output signal of memory 401, which is capable of executing the above exampled positional rule. Therein, word detector 421 recognizes an end of sentence word (address "99") and resets a counter 422. Counter 422 is responsive to advance signal pulses on lead 414 and is advanced every time a pulse appears on lead 414, at which time a new memory address appears at the input of block 403 on lead 430. A word detector 433 is connected to counter 422 to recognize and detect the state 3 of counter 422. Counter 422 reaches state 3 when the memory address corresponding to the third word in the sentence appears on lead 430 and the memory address of the second word in the sentence appears at the output of word delay 420 which is connected to lead 430 and which provides a one word delay. Thus, when a signal appears on lead 431, the memory address at the output of word delay 420 is the memory address of a second word of a sentence, and when a signal appears on signal 432, the memory address at the output of word delay 420 is the memory address of the last word of a sentence.

The signals on leads 431 and 432 are applied, in FIG. 5, to an intensity control element 425 and to a pitch-duration control element 424. When no signals are present on leads 431 and 432, the output signals of elements 425 and 424 are 1.0. When a signal appears on lead 431 only, the output signals of elements 425 and 424 are 1.3 and 1.2, respectively; and when a signal appears on lead 432 only, the output signals of elements 425 and 424 are 0.7 and 0.98, respectively. Elements 425 and 424 are implementable with simple combinatorial logic or with a small (4 word) read-only-memory in a manner well known to those skilled in the art. The output signal of word delay 420 (which is an address field) is juxtaposed (on parallel buses) with the output signal of intensity control element 425 (which is an intensity factor $K_t$), and is further juxtaposed with the output signal of pitch-duration control element 424 (which is a pitch-duration factor $K_{pd}$) to comprise the output signal of an emphasis control circuit 403, thereby developing control signals in accordance with the exampled positional rules.

The positional rule described above is quite sufficient for some applications. For other applications, a more sophisticated approach may be desired. Such more sophisticated approaches may include word and phrase stress control as described, for example, by J. H. Gaitenby, et al., in "Word and Phrase Stress by Rules for a Reading Machine," published in a *Status Report on Speech Research* by Haskins Laboratories, Inc., June 1972 (SR-29/30).

One implementation of emphasis control circuit 403 based on the syntax of the synthesized speech is described by Coker et al. in U.S. Pat. No. 3,704,345, issued Nov. 18, 1972. FIG. 1 of the Coker disclosure depicts a pitch and intensity generator 20, a vowel duration generator 21, and a consonant duration generator 22; all basically responsive to a syntax analyzer 13. These generators provide signals descriptive of the desired pitch, intensity, and duration associated with the phonemes specified in each memory address to be accessed. For purposes of this invention, instead of a phoneme dictionary 14 of Coker, a word dictionary may be used, and the vowel and consonant generators of Coker may be combined into a unified word duration generator.

The concatenated output signal of the emphasis control circuit 403 is stored in register 406 and the output signal of register 406 is applied to a register 407. Thus, when register 407 contains a present memory address, register 406 is said to contain the next memory address. Both registers 406 and 407 are connected to a selector circuit 408 which selects and transfers the output signals of either of the two registers to the selector's output.

The number of commands for accessing each memory location is controlled by inserting the pitch-duration factor value in the $K_{pd}$ field at the output of selector 408, on lead 409, into a down-counter 405. The basic memory accessing clock, $f_s$, generated in circuit 412, provides pulses which "count down" counter 405 while the memory is being accessed and read through OR gate 413 via lead 43. When counter 405 reaches zero, it develops an advance signal pulse on lead 414. This signal advances circuit 403 to the next memory state, causes register 406 to store the next memory state, and causes register 407 to store the new present state. Simultaneously, under command of the advance signal, selector 408 presents to leads 44 and 42 the contents of register 406, and pulse generator 410, responsive to the advance signal, provides an additional READ command to memory 30 through OR gate 413. The output pulse of generator 410 is also used, via strobe lead 21, to strobe the output signal of memory 30 into registers 910 in devices 91, thus storing in registers 910 the signals $S_i'''^2$, described above. When the advance signal on lead 414 disappears, selector 408 switches register 407 output signal to the output of the selector, and on the next pulse from clock 412 a new $K_{pd}$ is inserted into counter 405.

The state of counter 405 at any instant is indicated by the signal on lead 415. That signal represents the quantity $m_x - m_1$. The constant $K_{pd}$, which appears as the input signal to counter 405 (lead 409, represents the quantity $m_2 - m_1$. Therefore, the constant $K_c$ as defined by equation (2) is computed by divider 411, by dividing the signal on lead 415 by the signal on lead 409.

A careful study of the principles of the invention disclosed herein would reveal that, under certain circumstances, a computer program embodiment of this invention is possible, and may prove to be advantageous in certain respects. For example, if a prospective user of the speech synthesizing system of this invention finds it desirable to use complex syntax dependent synthesis rules and a complex spectrum interpolation approach, it may prove more feasible to use a computer embodiment for the emphasis control circuit 403 and for the interpolator 90 of FIG. 1. Once a computer is included in the system, additional features may be incorporated in the computer, thereby reducing the amount of special hardware required. For example, the intensity control operation of block 70 and the memory 30 may be incorporated into the computer, as can the phase vocoder analyzer and most of the phase vocoder synthesizer. A computer implementation for the phase vocoder analyzer and synthesizer was, in fact, utilized by Carlson in the aforementioned paper.

I claim:

1. Apparatus for generating natural sounding synthesized speech comprising:

a memory having stored therein phase vocoder encoded short-time spectrum envelope and phase derivative signals representative of a vocabulary of words;

means for extracting the signals of selected storage locations of said memory to affect the pitch and duration of said synthesized speech;

means for multiplying a plurality of the short-time spectrum envelope signals of said extracted signals by an intensity control factor; and decoder means responsive to the output signal of said means for multiplying and to the unaltered phase derivative signals of said extracted signal for phase vocoder decoding of the input signals of said decoder means.

2. The apparatus of claim 1 wherein said means for extracting comprises means for extracting the signal of each of said selected storage locations a repeated number of times to simultaneously affect the pitch and duration of said synthesized speech.

3. The apparatus of claim 1 further comprising interpolation means interposed between said means for multiplying and said decoder means for multiplying each of the intensity control factor multiplied signals by a factor dependent on the strength of the neighboring intensity control factor multiplied signals to effect a smoothing of the short-time spectrum envelope.

4. A method for synthesizing a natural sounding speech message comprising the steps of:

storing short-time spectrum envelope and phase derivative phase vocoder signals representative of a vocabulary of words;

selectively extracting from said stored signals preselected signals to form a pitch and duration modified predetermined sequence of signals representative of said speech message;

altering the extracted short-time spectrum envelope signals to affect the intensity of said speech message; and combining the extracted phase derivative signals and said intensity modified short-time spectrum envelope signals to form a signal appropriate for activating a speech synthesizer.

5. A method for composing speech messages from phase vocoder encoded and stored short-time spectrum envelope and phase derivative signals comprising the steps of:

extracting selected signals from said encoded and stored signals a repeated number of times to affect the pitch and duration of said composed speech message;

altering the short-time spectrum envelope signals of said extracted signals to affect the intensity of said composed speech message;

interpolating said altered short-time spectrum envelope signals to effect a smooth spectrum envelope; and phase vocoder decoding of the phase derivative signals of said extracted signals and of said interpolated short-time spectrum envelope signals to form a signal representative of said composed speech message.

* * * * *